US011850476B2

(12) United States Patent
Bousquet

(10) Patent No.: US 11,850,476 B2
(45) Date of Patent: Dec. 26, 2023

(54) MECHANICAL JUMP ROPE DEVICE

(71) Applicant: Gabriella Bousquet, Long Beach, CA (US)

(72) Inventor: Gabriella Bousquet, Long Beach, CA (US)

( * ) Notice: Subject to any disclaimer, the term of this patent is extended or adjusted under 35 U.S.C. 154(b) by 161 days.

(21) Appl. No.: 17/679,200

(22) Filed: Feb. 24, 2022

(65) Prior Publication Data

US 2023/0264061 A1 Aug. 24, 2023

(51) Int. Cl.
*A63B 5/20* (2006.01)
*A63B 21/00* (2006.01)

(52) U.S. Cl.
CPC ..... *A63B 5/20* (2013.01); *A63B 21/4035* (2015.10)

(58) Field of Classification Search
CPC ..... A63B 5/20; A63B 21/4035
See application file for complete search history.

(56) References Cited

U.S. PATENT DOCUMENTS 3,061,307 A * 10/1962 Burr ..... A63B 5/20 482/82
3,315,959 A * 4/1967 Carnielli ..... A63B 21/4047 482/118
4,184,677 A * 1/1980 Murray ..... A63B 5/20 482/82
4,733,861 A * 3/1988 Plunkett, III .... A63B 21/00185 482/125
4,869,492 A * 9/1989 Joutras ..... A63B 21/4047 482/44
D305,447 S * 1/1990 Valentine ..... D21/672
5,746,687 A * 5/1998 Vial ..... A63B 21/0552 482/125
5,842,956 A * 12/1998 Strachan ..... A63B 5/20 482/81
5,885,196 A * 3/1999 Gvoich ..... A63B 21/00185 482/125
6,139,476 A * 10/2000 Gallant ..... A63B 21/157 482/114
6,402,668 B1 * 6/2002 Harker ..... A63B 21/0552 482/121
6,409,636 B1 6/2002 Risso
6,648,804 B2 * 11/2003 Chen ..... A63B 21/0004 482/125
7,326,157 B2 * 2/2008 Wu ..... A63B 21/0552 482/121
7,361,074 B1 * 4/2008 Periman ..... A63H 37/00 362/199

(Continued)

FOREIGN PATENT DOCUMENTS

WO WO2017031307 2/2017

*Primary Examiner* — Nyca T Nguyen

(57) ABSTRACT

A mechanical jump rope device for forward rotation of the rope with backward rotation obstructed by a ratchet and pawl mechanism includes a semicircular rope having a pair of ends. Each of the ends is coupled to a respective one of each handle of a pair of handles. Each of the ends of the rope engages by a ratchet and pawl mechanism with each of the handles. A distal end of each of the handles engages by a push button locking mechanism to a bar. Each of the handles can be attached or removed from the bar. The user can use the mechanical jump rope device with or without the bar. The rope rotates forward and the user jumps over the rope. Backward rotation of the rope is hindered by the ratchet and pawl mechanism.

15 Claims, 7 Drawing Sheets

(56) References Cited

U.S. PATENT DOCUMENTS

| | | | | |
|---|---|---|---|---|
| 7,578,775 | B2 * | 8/2009 | Terry | A63B 21/4009 482/121 |
| 7,846,078 | B1 * | 12/2010 | Park | A63B 23/03525 482/121 |
| 7,922,634 | B1 * | 4/2011 | Wu | A63B 23/1263 482/121 |
| 7,976,438 | B1 | 7/2011 | Hsu | |
| 8,348,814 | B1 * | 1/2013 | Hinds | A63B 21/4043 482/82 |
| 9,211,429 | B2 | 12/2015 | Heinrich | |
| 9,757,604 | B2 * | 9/2017 | Carter | A63B 5/20 |
| 9,884,218 | B2 | 2/2018 | Harguth | |
| 9,919,176 | B2 * | 3/2018 | Christie | A63B 21/00061 |
| D847,917 | S | 5/2019 | Cullen | |
| 10,933,270 | B2 * | 3/2021 | Gagne | A63B 5/20 |
| 11,033,774 | B1 * | 6/2021 | Clarke | A63B 21/00185 |
| 2004/0218383 | A1 * | 11/2004 | Bailey, III | A63B 5/20 362/269 |
| 2014/0121068 | A1 * | 5/2014 | Rogers | A63B 5/20 482/82 |
| 2014/0228180 | A1 * | 8/2014 | Walker | A63B 21/0557 482/82 |
| 2014/0342883 | A1 * | 11/2014 | Joost | A63B 21/0555 482/129 |
| 2019/0118019 | A1 * | 4/2019 | Hunt | A63B 5/20 |

* cited by examiner

MECHANICAL JUMP ROPE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to jump rope devices and more particularly pertains to a new jump rope device for forward rotation of the rope with backward rotation obstructed by a ratchet and pawl mechanism.

(2) Description of Related Art Including Information Disclosed Under 37 CFR 1.97 and 1.98

The prior art relates to jump rope devices. The prior art includes a variety of jump ropes being configured for forward and backward rotation of the rope. Furthermore, a variety of prior art includes configurations to the handles of the jump rope. Know prior art lacks a jump rope device being configured for forward rotation of the rope whereby backward rotation is prohibited by a ratchet and pawl mechanism within the handles.

BRIEF SUMMARY OF THE INVENTION

An embodiment of the disclosure meets the needs presented above by generally comprising a rope. The rope has a semicircular shape and a pair of ends. Each of the ends is coupled to an end of each handle of a pair of handles. Each of the ends of the rope engages by a ratchet and pawl mechanism to each of the handles. The rope is configured for forward rotation and restricted to backward rotation by the ratchet and pawl mechanism. A distal end of each of the handles has an aperture. A bar having a pair of ends has a button coupled to each of the ends of the bar. The button is a spring loaded release button and is configured for being inserted into the aperture of each of the handles. Each of the handles is configured for being attachable and detachable to the bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
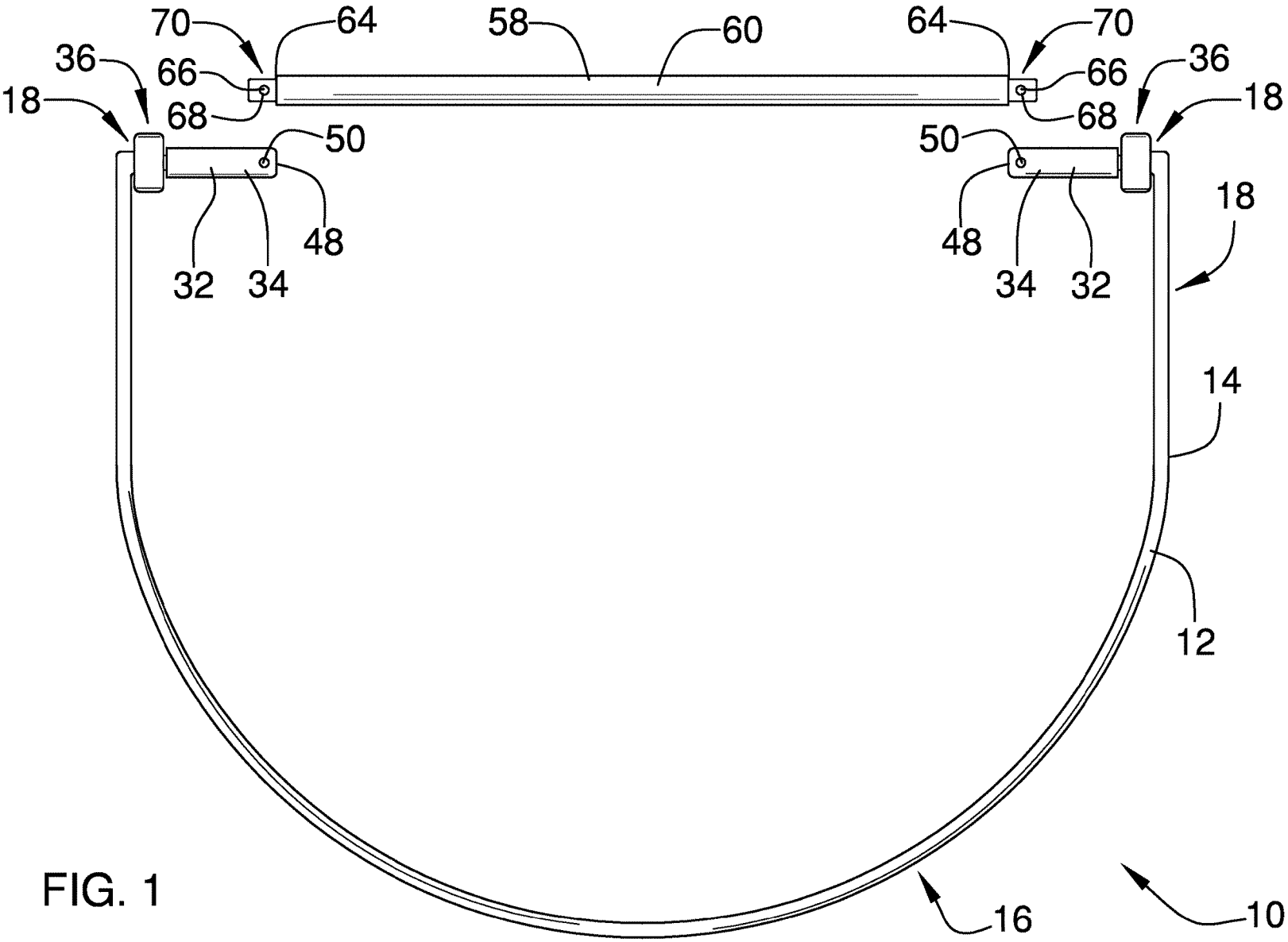
FIG. 1 is a front view of a Mechanical Jump Rope Device according to an embodiment of the disclosure.

With reference now to the drawings, and in particular to FIGS. 1 through 8 thereof, a new jump rope device embodying the principles and concepts of an embodiment of the disclosure and generally designated by the reference numeral 10 will be described.

As best illustrated in FIGS. 1 through 8, the mechanical jump rope device 10 generally comprises a rope 12. The rope 12 is a plastic material 14. The rope 12 has a semicircular shape 16 as shown in FIG. 1. The rope 12 is configured for the user 11 to jump over as the rope 12 rotates forward repeatedly.

The rope 12 is a durable material 18. The durable material 18 defines the rope 12 to being resistant damage from impact. The rope 12 has a pair of ends 20. Each of the ends 20 is a first portion 22 of a ratchet and pawl mechanism 24. Each of the ends 20 is a ratchet wheel 26. The ratchet wheel 26 has a ratchet shaft 28 and the ratchet shaft 28 is positioned in a center 30 of the ratchet wheel 26.

Figure 5:
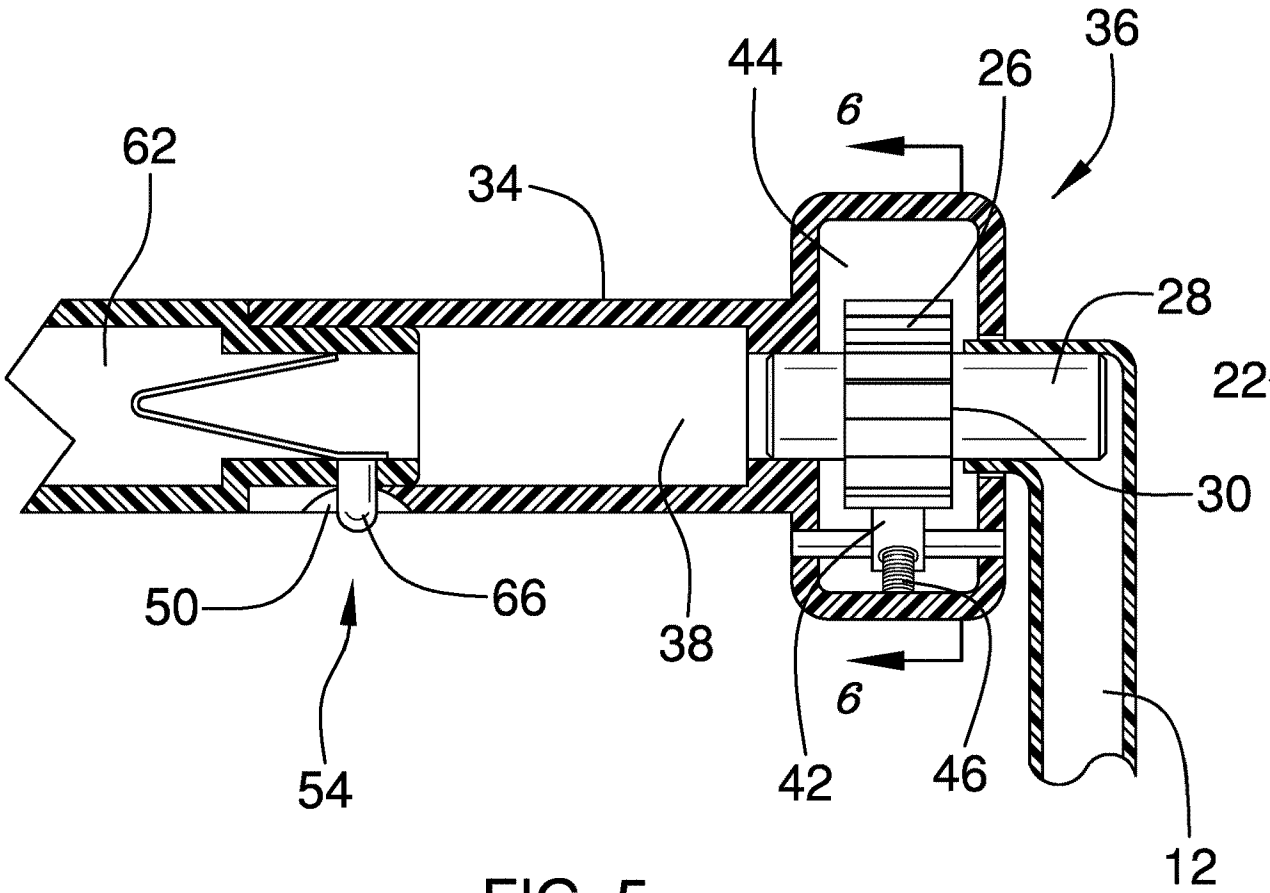
FIG. 5 is a cross sectional view of line 5-5 of FIG. 3 of an embodiment of the disclosure.

Each handle 32 of a pair of handles 32 has a cylindrical shaped body 34. Each of the handles 32 has an end 36. The end 36 of each of the handles 32 is coupled to each of the ends 20 of the rope 12 as shown in FIG. 5. Each of the handles 32 has an interior 38 where the interior 38 defines a space for the second portion 40 of the ratchet and pawl mechanism 24 to be stored.

The second portion 40 has a pawl 42. The pawl 42 is coupled to an interior wall 44 of the cylindrical shaped body 34. A spring 46 is positioned underneath the pawl 42. The spring 46 is configured for providing spring loaded force to the pawl 42. The pawl 42 is configured for retaining the ratchet wheel 26 from backward rotation. The pawl 42 and the ratchet wheel 26 are complementary to each other and engage by the ratchet and pawl mechanism 24.

A distal end 48 of each of the handles 32 is distal relative to each of the ends 20 of the rope 12. The distal end 48 has an aperture 50. The aperture 50 is circular. The aperture 50 is the first portion 52 of a push button locking mechanism 54. The aperture 50 is on a side 56 of the each of the handles 32. The positioning of the aperture 50 is configured for providing easy arrangement of the thumb 13 of the user 11 to the aperture 50.

A bar 58 has cylindrical body 60 and a hollow interior 62. The bar 60 has a pair of ends 64. A button 66 is coupled to each of the ends 64. The button 66 is a spring loaded release button 68. The button 66 is the second portion 70 of the push button locking mechanism 54 and is complementary to the aperture 50 of each of the handles 32.

As shown in FIG. 5, the button 66 is configured for engaging by the push button locking mechanism 54 with the aperture 50 whereby the button 66 is positioned within the aperture 50 to lock each of the handles 32 to a respective one of each of the ends 64 of the bar 58. The purpose of the bar 58 is to border the mechanical jump rope device 10 in an enclosed circle 15 and assist the user 11 with using the mechanical jump rope device as shown in FIG. 2.

Figure 2:
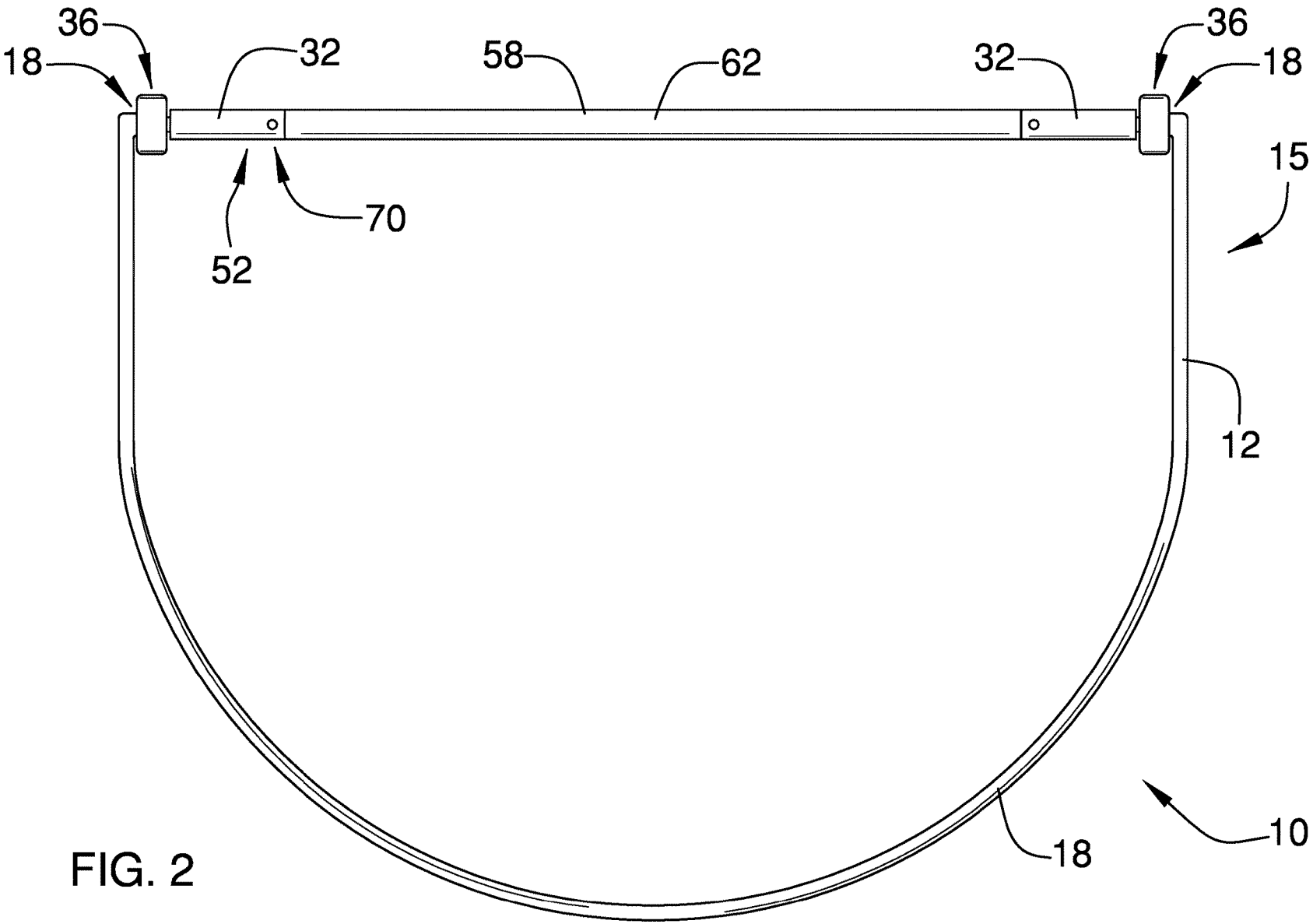
FIG. 2 is a front view of an embodiment of the disclosure.
Figure 3:
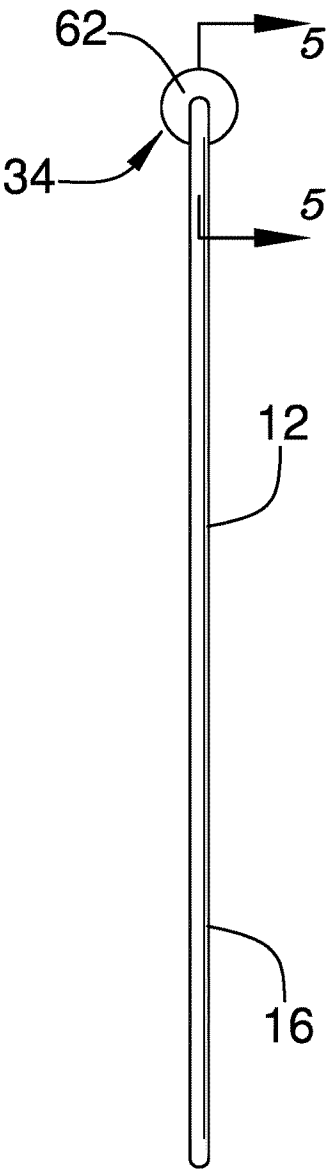
FIG. 3 is a side view of an embodiment of the disclosure.
Figure 8:
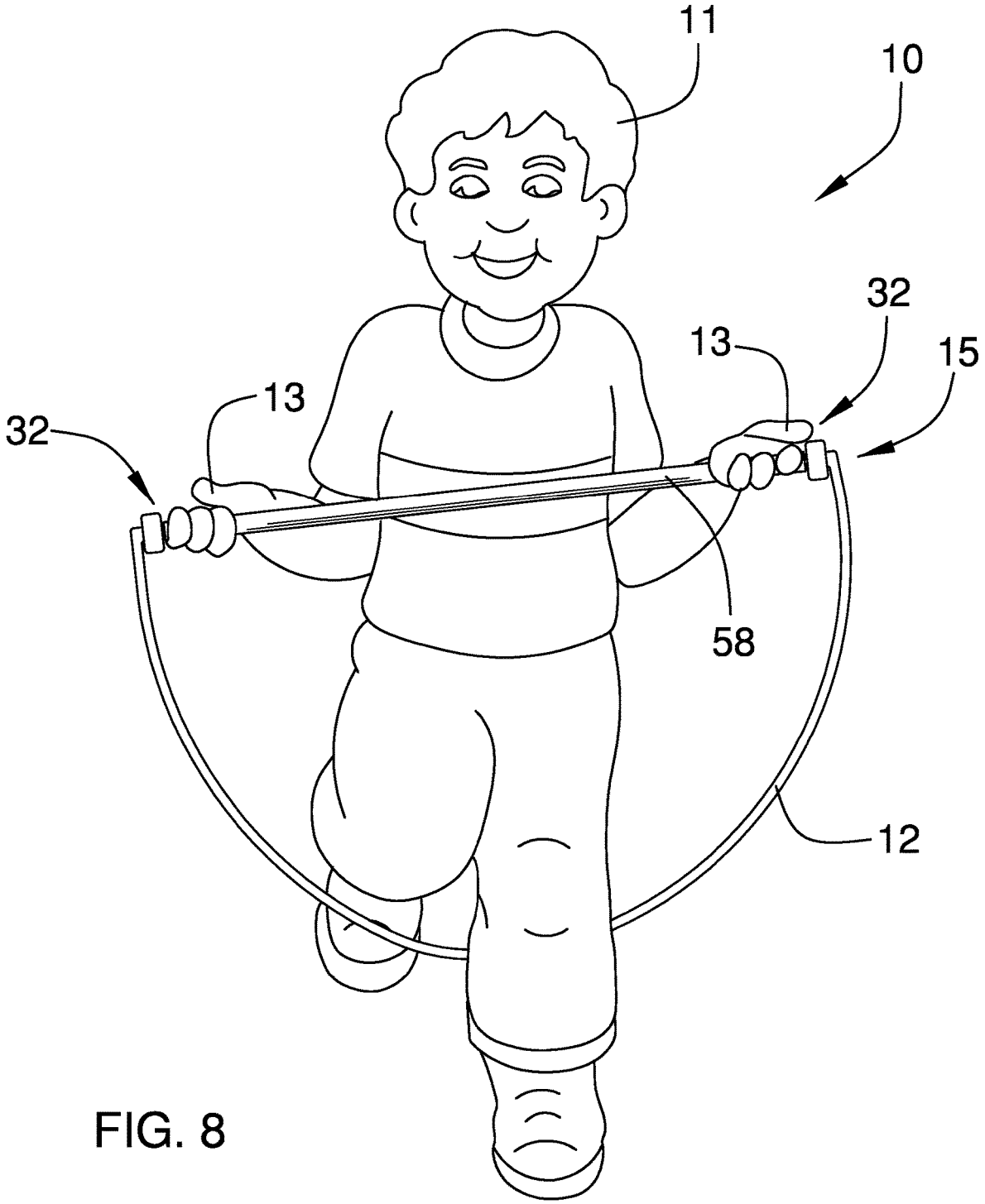
FIG. 8 is an in-use view of an embodiment of the disclosure.

In use, the user 11 can attach or detach each of the handles 32 from the bar 58 as shown in FIG. 1 and FIG. 2 respectively. When the mechanical jump rope device 10 has the bar 58 attached, then the user 11 can hold either the bar 58 or each of the handles 32 and jump over the rope 12 as shown in FIG. 8.

Figure 7:
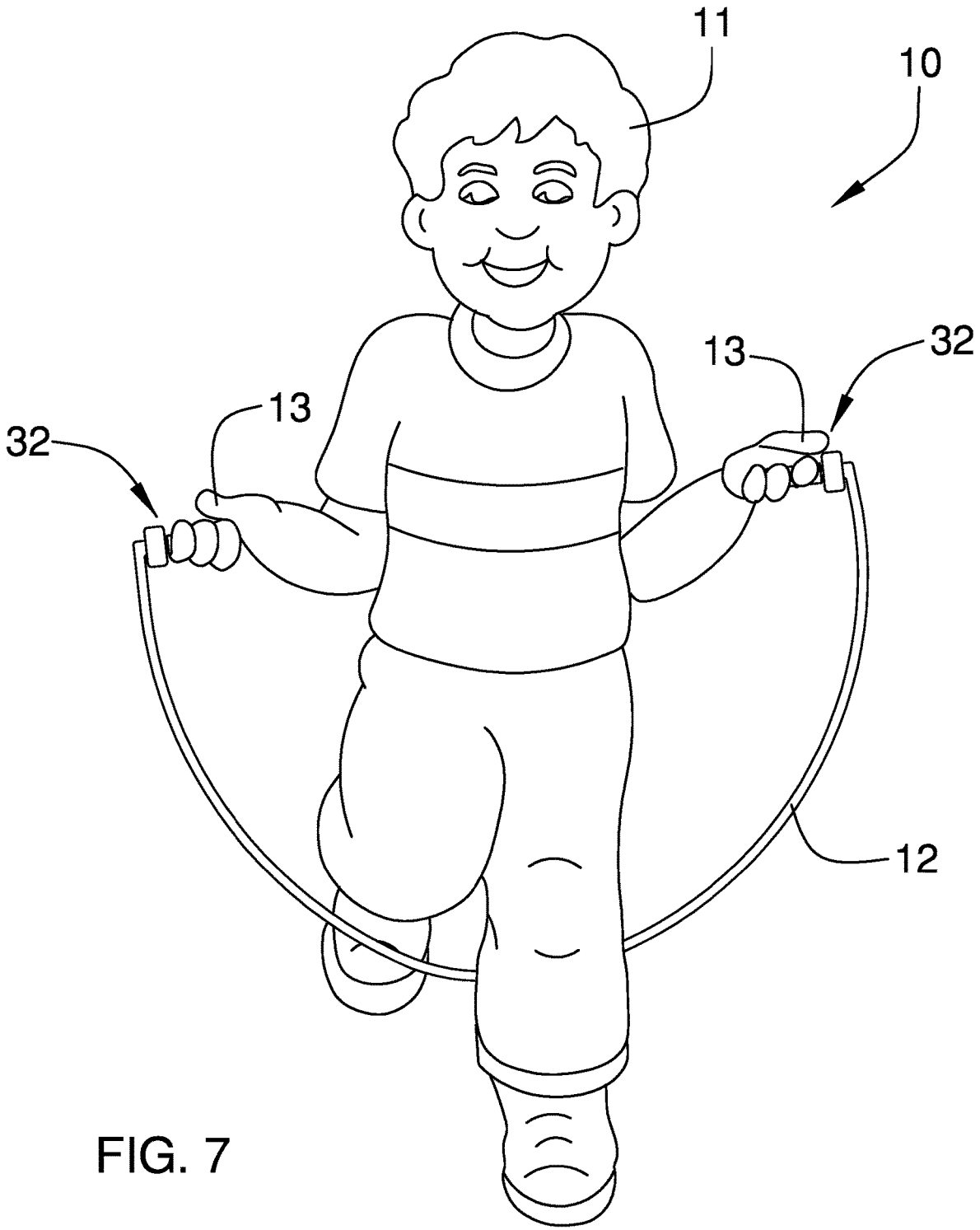
FIG. 7 is an in-use view of an embodiment of the disclosure.

When the bar 58 is detached from the mechanical jump rope device 10, then the user 11 can hold each of the handles 32 and jump over the rope 12 as shown in FIG. 7. In either variation of the mechanical jump rope device 10, the rope 12 is configured for forward rotation relative to each of the handles 32. Backward rotation of the rope 12 is hindered due to the ratchet and pawl mechanism 24.

Figure 4:
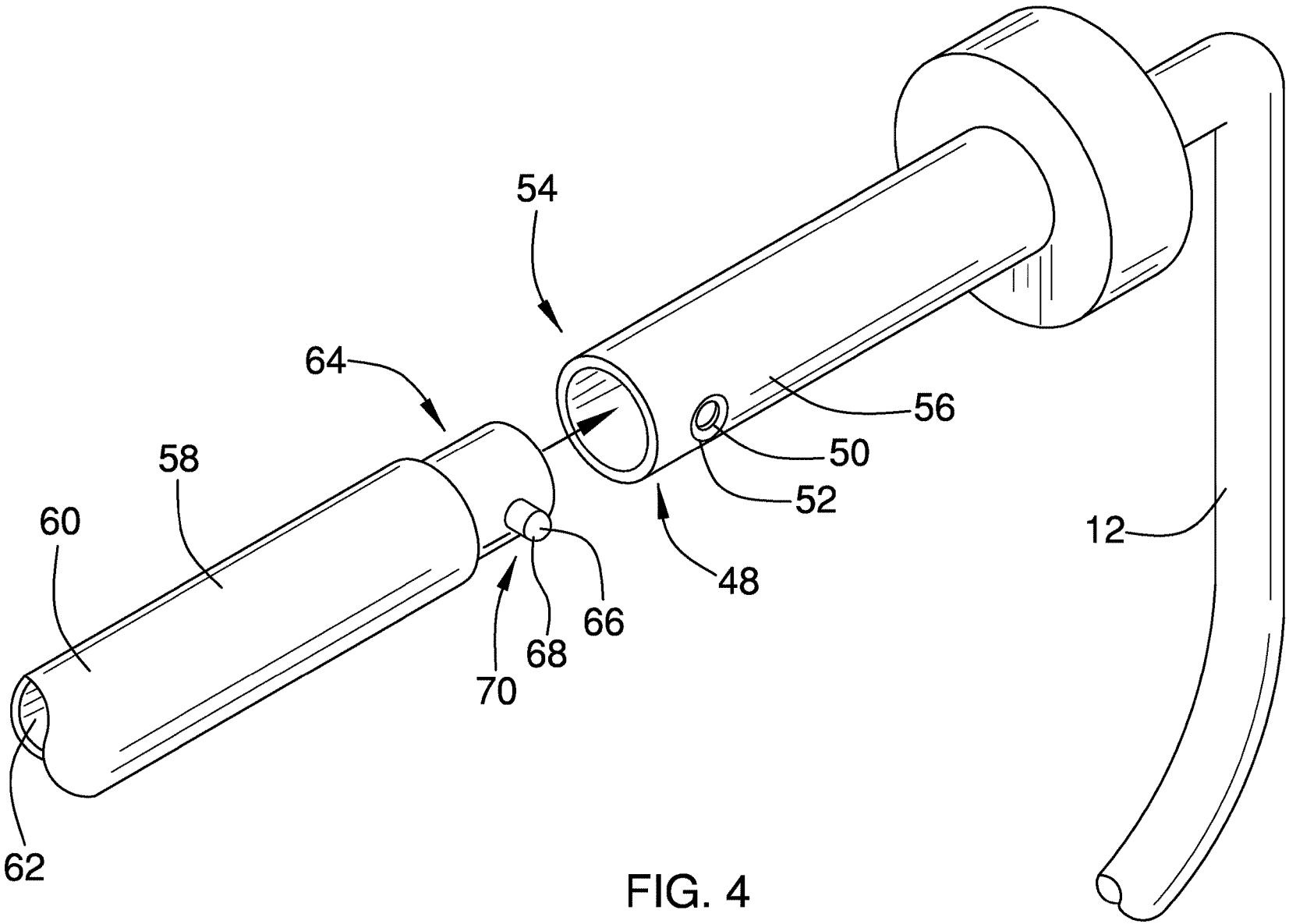
FIG. 4 is an exploded partial-isometric view of an embodiment of the disclosure.
Figure 6:
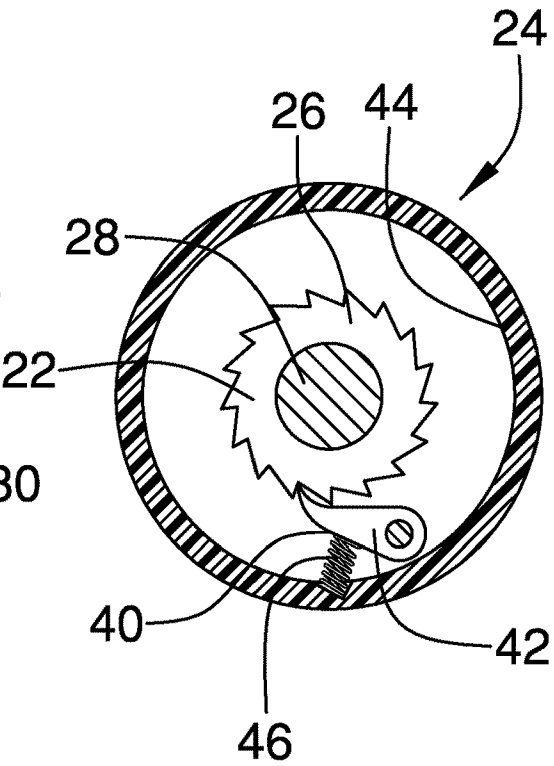
FIG. 6 is a cross sectional view of line 6-6 of FIG. 5 of an embodiment of the disclosure.

The bar 58 can be attached or detached from each of the handles 32 using the push button locking mechanism 54 as shown in FIG. 4. When attaching, the user 11 slides the distal ends 48 of each of the handles 32 into a respective one of each of the ends 64 of the bar 58. The button 66 of each of the ends 64 of the bar 58 locks into the aperture 50 of each of the handles 32 by spring force and retains each of the handles 32 in a fixed position relative to the bar 58.

When detaching each of the handles 32 from the bar 58, the thumb 13 of the user 11 pushes the button 66 inward towards the bar 58 to release the button 66 from the aperture 50. Furthermore, the user 11 then removes each of the handles 32 from the bar 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A jump rope device comprising:

a rope, said rope having a pair of ends, each of said ends being a first portion of a ratchet and pawl mechanism;

a pair of handles, each of said ends of said rope being coupled to an end of each of said handles, each of said handles having an interior, said interior defines a space where a second portion of said ratchet and pawl mechanism being positioned, each of said handles having a distal end, said distal end having an aperture, said aperture being a first portion of a push button locking mechanism; and a bar, said bar having a pair of ends, each of said ends having a button, said button being a second portion of said push button locking mechanism.

2. The jump rope device of claim 1, further comprising said second portion having a port, said port having a pawl, said pawl being configured for restraining said ratchet wheel from backward rotation.

3. The jump rope device of claim 2, further comprising a spring being positioned beneath and relative to said pawl, said spring being configured for enabling said pawl to be spring loaded, said pawl being complementary to said ratchet wheel, said pawl being configured for engagement with said ratchet wheel.

4. The jump rope device of claim 1, further comprising said button being configured for being inserted into said aperture of each of said handles, said button being a spring loaded release button, said aperture of each of said handles being complementary to said button of each of said ends of said bar.

5. The jump rope device of claim 4, further comprising each of said handles being configured for engaging by said push button locking mechanism with a respective one of each of said ends of said bar.

6. The jump rope device of claim 1, further comprising said rope being a plastic material.

7. The jump rope device of claim 1, wherein each of said ratchet and pawl mechanisms comprise a ratchet wheel, said ratchet wheel having a ratchet shaft, said ratchet shaft being positioned in a center of said ratchet wheel.

8. The jump rope device of claim 1, further comprising said rope being in a semicircular shape.

9. The jump rope device of claim 1, further comprising said rope being a durable material, said durable material defines said rope being resistant to impact from the environment or from a user.

10. The jump rope device of claim 1, further comprising each of said handles having a cylindrical shaped body.

11. The jump rope device of claim 1, further comprising each of said ends of said rope being configured for forward rotation.

12. The jump rope device of claim 1, further comprising said distal end being distal relative to each of said ends of said rope.

13. The jump rope device of claim 1, further comprising said distal end having an aperture, said aperture being circular.

14. The jump rope device of claim 1, further comprising said bar being a tube, said tube having a cylindrical body, said bar having a hollow interior.

15. A jump rope device comprising:

a rope, said rope being a plastic material, said rope having a pair of ends, each of said ends being a first portion of a ratchet and pawl mechanism, each of said ends comprising a ratchet wheel, said ratchet wheel having a ratchet shaft, said ratchet shaft being positioned in a center of said ratchet wheel, said rope being in a semicircular shape, said rope being a durable material, said durable material defines said rope being resistant to impact from the environment or from a user;

a pair of handles, each of said ends of said rope being coupled to an end of each of said handles, each of said handles having a cylindrical shaped body, each of said handles having an interior, said interior defines a space where a second portion of said ratchet and pawl mechanism being positioned, said second portion having a port, said port having a pawl, said pawl being configured for restraining said ratchet wheel from backward rotation, a spring being positioned beneath and relative to said pawl, said spring being configured for enabling said pawl to be spring loaded, said pawl being complementary to said ratchet wheel, said pawl being configured for engagement with said ratchet wheel, each of said ends of said rope being configured for forward rotation, each of said handles having a distal end, said distal end being distal relative to each of said ends of said rope, said distal end having an aperture, said aperture being circular, said aperture being a first portion of a push button locking mechanism; and a bar, said bar being a tube, said tube having a cylindrical body, said bar having a hollow interior, said bar having a pair of ends, each of said ends having a button, said button being configured for being inserted into said aperture of each of said handles, said button being a spring loaded release button, said button being a second portion of said push button locking mechanism, said aperture of each of said handles being complementary to said button of each of said ends of said bar, each of said handles being configured for engaging by said push button locking mechanism with a respective one of each of said ends of said bar.

* * * * *